US006057285A

United States Patent [19]

Pèscador et al.

[11] Patent Number: 6,057,285

[45] Date of Patent: May 2, 2000

[54] STABLE RINSE CYCLE FABRIC SOFTENER COMPOSITION WITH GMS CO-SOFTENER

[75] Inventors: José Javier Tovar Pèscador, Iztacalco D.F.; Salvador Jantes Hernández, Miguel Hidalgo D.F., both of Mexico; Alain Jacques, Blegny, Belgium

[73] Assignee: Colgate-Palmolive Co., New York, N.Y.

[21] Appl. No.: 09/237,528

[22] Filed: Jan. 27, 1999

Related U.S. Application Data

[63] Continuation-in-part of application No. 09/070,453, Apr. 30, 1998, abandoned, which is a continuation-in-part of application No. 09/026,194, Feb. 19, 1998, abandoned.

[51] Int. Cl.[7] ..... C11D 1/835

[52] U.S. Cl. ..... 510/527; 510/524

[58] Field of Search ..... 510/504, 524, 510/527

[56] References Cited

U.S. PATENT DOCUMENTS

| | | | |
|---|---|---|---|
| 5,066,414 | 11/1991 | Chang et al. | 252/8.8 |
| 5,747,108 | 5/1998 | Farooq et al. | 427/242 |

FOREIGN PATENT DOCUMENTS

| | | |
|---|---|---|
| 0691396 | 1/1996 | European Pat. Off. . |
| 829531 A1 | 3/1998 | European Pat. Off. . |
| 19623764 | 12/1997 | Germany . |
| WO 94/04643 | 3/1994 | WIPO . |
| WO 98/01522 | 1/1998 | WIPO . |

*Primary Examiner*—John R. Hardee
*Attorney, Agent, or Firm*—Bernard Lieberman

[57] ABSTRACT

Rinse cycle fabric softeners are described which are stable and pourable and which contain a quaternary diester fabric softener such as N-methyl, N,N,N-triethanolamine ditallow ester quaternary ammonium salt in combination with glycerol monostearate and a fatty alcohol ethoxylate nonionic surfactant as the emulsifier having an HLB value above 7.5.

7 Claims, No Drawings

STABLE RINSE CYCLE FABRIC SOFTENER COMPOSITION WITH GMS CO-SOFTENER

This application is a continuation-in-part of prior U.S. application Ser. No. 09/070,453 filed Apr. 30, 1998 now abandoned which in turn is a continuation-in-part of U.S. application Ser. No. 09/026,194 filed Feb. 19, 1998, now abandoned the disclosures of which are incorporated herein by reference.

FIELD OF THE INVENTION

This invention relates to liquid fabric softening compositions intended for use in the rinse cycle of an automatic fabric washing machine and for hand use. More particularly, this invention is concerned with aqueous fabric softening compositions which provide improved softness to fabrics concomitant with improved product stability as manifested by properties such as uniform viscosity over a wide range of temperature and avoidance of phase separation.

Compositions containing quaternary ammonium salts are commonly used to provide fabric softening benefits when used in a laundry rinse operation. Numerous patents have been issued for these types of compounds and compositions.

More recently, however, in view of concerns for the environmental safety (e.g. biodegradability) of the quaternary ammonium compound softeners, there have been many proposals for partial or total replacement of the conventional "quat" fabric softener which are exemplified by dimethyl distearyl (or ditallow) ammonium chloride.

For instance, in U.S. Pat. No. 5,133,885 to L. Contor, et al. (corresponding to EP 0423894, both assigned to Colgate-Palmolive Company, the assignee of the present invention) fabric softening compositions are described which are aqueous dispersions of a fatty acid ester quat of formula:

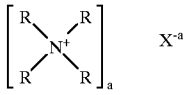

where one or two R groups represent an aliphatic ester residue of from 12 to 30 carbon atoms, and the remaining R groups represent lower aliphatic, aryl or hydroxyalkyl groups, $X^-$ is an anion and "a" represents the ionic valence of the anion, and a fatty acid amidoamine softener of formula:

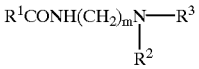

where $R^1$ is a $C_{12}$ to $C_{30}$ alkyl or alkenyl group, $R^2$ represents $R^1$,$R^1CONH(CH_2)_m$ or $CH_2CH_2OH$; $R^3$ represents hydrogen, methyl, or $(CH_2CH_2O)_pH$, m is a number of 1 to 5 and p is a number of 1 to 5, at a weight ratio of ester quat to amidoamine of from 10:1 to 1:10.

U.S. Pat. No. 4,844,823 to Jacques et al discloses fabric softener compositions wherein a preferred class of softeners are the diesterified long chain fatty acid quaternary ammonium compounds.

Glycerol monostearate (GMS) is a known emulsifier for the aforementioned esterified quaternary ammonium softeners, commonly referred to as "ester quat" softeners. U.S. Pat. No. 5,066,414 to Chang describes fabric softening compositions containing an ester quat which is a mono or di-ester variation of ditallow dimethyl ammonium chloride (DTDMAC) in combination with glycerol monostearate and a linear alkoxylated alcohol selected from the condensation products of $C_8$–$C_{18}$ linear fatty alcohols with from 1 to about 10 moles of ethylene oxide.

U.S. Pat. No. 5,545,350 to Baker et al describes fabric softener compositions comprised of a diester quaternary ammonium compound optionally further containing a nonionic softener such as a sorbitan ester as an additional softening agent. At column 13, lines 22–24, the patentees indicate that "glycerol monostearate having a low HLB has a detrimental effect on stability of the compositions." Further, at column 14, lines 65–67, the patentees state that "the compositions of the present invention are essentially free of glycerol monostearate (GMS)." The reason provided is that the low HLB of GMS causes phase separation and/or stability problems in the compositions described in the patent.

Notwithstanding disclosures in the prior art directed to the combination of diester quaternary ammonium compound softeners with a co-softener there remains a need to deliver improved softness to a diester quat softening composition without adversely affecting product stability and viscosity.

SUMMARY OF THE INVENTION

In accordance with the present invention, there is provided a stable, pourable and water dispersible fabric softener composition comprising:

(a) from about 1% to about 25% by weight of a combination of fabric softening components (A) and (B) wherein (A) is a biodegradable fatty ester quaternary ammonium compound of formula (I):

(I)

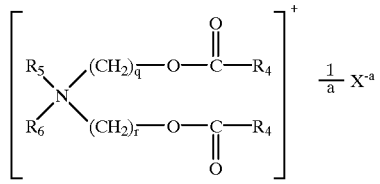

wherein each $R_4$ independently represents an aliphatic hydrocarbon group having from 8 to 22 carbon atoms, $R_5$ represents $(CH_2)_s$—$R_7$ where $R_7$ represents an alkoxy carbonyl group containing from 8 to 22 carbon atoms, benzyl, phenyl, ($C_1$–$C_4$)-alkyl substituted phenyl, OH or H; $R_6$ represents $(CH_2)_tR_8$ where $R_8$ represents benzyl, phenyl, ($C_1$–$C_4$) alkyl substituted phenyl, OH or H; q, r, s and t, each independently, represent a number of from 1 to 3; and x is an anion of valence a; and (B) is glycerol monostearate;

(b) an effective amount of an emulsifier comprising a fatty alcohol ethoxylate nonionic surfactant having a hydrophilic-lipophilic balance (HLB) value greater than about 7.5 as measured by the Davies Group number method; and (c) an aqueous solvent.

The present invention also provides a method of imparting softness to fabrics by contacting the fabrics with a softening effective amount of the fabric softener composition of the invention; generally and preferably, in the rinse cycle of an automatic laundry washing machine.

The present invention is predicated on the discovery that glycerol monostearate (GMS) can be used effectively as a co-softener in conjunction with a diester quaternary ammonium compound as herein described without adversely affecting viscosity and overall product stability with the proviso that an emulsifier is selected in accordance with the invention having an HLB value of greater than 7.5. The HLB value is calculated for purposes of the present invention using the Davies group number values as described in Proceedings 2$^{nd}$ Intern. Congress on Surface Activity, Butterworths, London (1957). According to this method of calculation, an HLB value of 7 signifies that a surfactant has the same affinity for the aqueous phase as for the oily phase. Negative values are assigned to the lipophilic groups in the molecule and positive values to the hydrophilic groups. The HLB of a given surfactant is calculated by adding to the number 7 the sum of the positive values representing the hydrophilic groups and by subtracting the negative values representing the hydrophobic groups.

For example, the fatty alcohol ethoxylate nonionic surfactant which is used as the emulsifier in the composition of the invention has the following assigned Davies group number values for the groups present in the surfactant molecule.

| Group | Value |
|---|---|
| —$CH_2$— | −0.475 |
| —$CH_3$— | −0.475 |
| —($CH_2$—$CH_2$—O)— | +0.33 |
| —O— | +1.3 |

By way of illustration, the HLB of a nonionic surfactant emulsifier useful herein, $C_{13}$–$C_{15}$ EO 20:1, is calculated as shown below. This nonionic surfactant is a fatty alcohol having an average of 13 to 15 carbon atoms ethoxylated with 20 moles of ethylene oxide per mole of alcohol.

For purposes of simplicity the length of the alkyl chain is averaged at $C_{14}$. The resulting molecule is then comprised of the following groups:

1 $CH_3$—; 13—$CH_2$—; 1—O—; and 20—($CH_2$—$CH_2$—O)—

Based on the above, the HLB is calculated as follows:

$$HLB=7+[1\times(-0.475)]+[13\times(-0.475)]+[1\times(1.3)]+[20\times(0.33)]HLB=8.25$$

DETAILED DESCRIPTION OF THE INVENTION

The principal softening compound according to the invention is the fatty ester quaternary ammonium compound having the following formula:

(I)

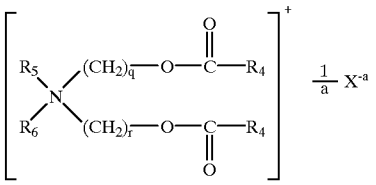

Each $R_4$ independently represents an aliphatic hydrocarbon group having from 8 to 22 carbon atoms, and preferably 14 to 18 carbon atoms. $R_5$ represents the group $(CH_2)_s$—$R_7$ which, depending on $R_7$, may represent a long chain alkyl ester group ($R_7$=$C_8$–$C_{22}$ alkoxy carbonyl), in which case the compounds of formula (I) are triester quaternary ammonium compounds. $R_6$ represents $(CH_2)_rR_8$ as defined above.

Preferably, however, the fatty ester quaternary compounds are diester compounds, i.e. $R_7$ represents benzyl, phenyl, phenyl substituted by $C_1$–$C_4$ alkyl, hydroxyl (OH) or hydrogen (H). Most preferably $R_7$ represent OH or H, especially preferably OH, e.g. $R_5$ is hydroxyethyl.

q, r and s, each, independently, represents a number of from 1 to 3.

X represents a counter ion of valence a such as $Cl^-$, $Br^-$, $CH_3OSO_3^-$, $CH_3CH_2OSO_3^-$, and the like. For example, the diester quat of formula (II) may be a compound of the formula:

(II)

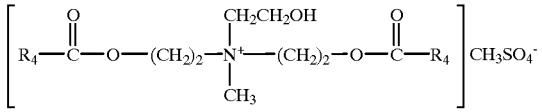

where each $R_4$ may be, for example, derived from hard or soft tallow, coco, stearyl, oleyl, and the like. Such compounds are commercially available as, for example, Tetranyl AT-75, from Kao Corp. Japan, which is di-tallow ester triethanol amine quaternary ammonium methyl sulfate. Tetranyl AT-75 is based on a mixture of about 25% hard tallow and about 75% soft tallow. Accordingly, this product contains about 34% of unsaturated alkyl chains. A second example would be Hipochem X-89107, from High Point Chemical Corp.; which is an analogue of the Tetranyl AT-75 with about 100% saturation in the tallow moieties. However, in general the quatemized ammonium ester compound of formula (III) may contain from about 5% to about 75% of unsaturated (long-chain) alkyl groups.

Glycerol monostearate (GMS) is the co-softener used in combination with the fatty ester quaternary ammonium compound softener described above. The range of fatty ester quat in the composition will generally vary from about 1% to about 20%, by weight, of the composition; preferably a range of from about 1% to about 12%; and most preferably a range of from about 2% to about 10%, by weight. The amount of GMS in the composition will vary from about 0.1% to about 8%, by weight; preferably from about 0.5% to about 8%, by weight, and most preferably from about 0.5% to about 5%, by weight.

The emulsifier used in the present fabric softening composition is required to stabilize the composition and prevent phase separation and/or an unstable viscosity over a period of at least several months or over a range of temperatures wherein such composition would otherwise be destabilized by the presence of the GMS in the composition in the absence of such emulsifier. The fatty alcohol ethoxylates useful in the invention correspond to ethylene oxide condensation products of higher fatty alcohols, with the higher fatty alcohol being of from about 9 to 15 carbon atoms and the number of ethylene oxide groups per mole being from about 10 to 30. In the preferred fatty alcohol ethoxylates for use herein, the alkyl chain length ranges from about 13 to 15 carbon atoms and the number of ethylene groups ranges from about 15 to 20 per mole. Especially preferred for use herein is Synperonic A20 manufactured by ICI Chemicals, such nonionic surfactant being an ethoxylated $C_{13}$–$C_{15}$ fatty alcohol with 20 moles of ethylene oxide per mole of alcohol and having an HLB of 8.25.

In general, the HLB of the nonionic fatty alcohol ethoxylates are from about 7.5 to about 10, with an HLB range of from about 8 to about 9 being preferred. They arc used in the composition in sufficient amount to provide emulsification, typically from about 1 to 5%, by weight of the composition.

The compositions of this invention are provided as aqueous dispersions in which the fabric softener compounds are present in finely divided form stably dispersed in the aqueous phase. Generally, particle sizes of the dispersed particles of less than about 25 microns ($\mu$m), preferably less than 20 $\mu$m, especially preferably no more than 10 $\mu$m, on average are acceptable for both softening and stability insofar as the particle sizes can be maintained during actual use, typically in the rinse cycle of an automatic laundry washing machine.

The aqueous phase of the dispersion is primarily water, usually deionized or distilled water. Small amounts (e.g. up to about 5% by weight) of co-solvent may be present for adjustment of viscosity. Typically, as the co-solvent lower mono- and poly-hydroxy alcohols will be used, generally in amounts up to about 5% by weight of the composition. The preferred alcohols and aqueous are those having from 2 to 4 carbon atoms, such as, for example, ethanol, propanol, isopropanol, and propylene glycol or ethylene glycol. Isopropyl alcohol (2-propanol) is especially preferred. However, co-solvents are not required and are generally avoided.

The compositions of this invention include an electrolyte to reduce dispersion viscosity. Generally, any of the alkaline metals or alkaline earth metal salts of the mineral acids can be used as electrolyte. In view of availability, solubility and low toxicity, NaCl, $CaCl_2$, $MgCl_2$ and $MgSO_4$ and similar salts of alkaline and alkaline earth metals are preferred, and $CaCl_2$ is especially preferred. The amount of the electrolyte will be selected to assure that the composition does not form a gel. Generally, amounts of electrolyte salt of from about 0.05 to 2.0 wt %, preferably 0.1 to 1.5 wt %, especially preferably 0.25 to 1.4 wt %, will effectively prevent gelation from occurring.

The fabric softener compositions of the invention are formulated to be free of an inorganic mineral acid as well as an organic acid because the presence of such acid ingredients may adversely affect the desired rheology and/or stability of the resulting composition.

Optional components commonly used in fabric softening compositions may be added in minor amounts to enhance either the appearance or performance properties of the liquid fabric softener compositions of this invention. Typical components of this type include, but are not limited to colorants, e.g., dyes or pigments, rheology modifiers, color protection agents, stain-guard agents, preservatives, germicides, and perfumes.

The final product, whether in concentrated or diluted form must be easily pourable by the end user. Generally, therefore, final product viscosity (for a freshly prepared sample) should not exceed about 400 centipoise, preferably not more than 300 centipoise, but should not be too low, for example not less than about 50 centipoise. The preferred viscosity for the invention concentrated product is in the range of 120 to 300 centipoise. As used herein, unless otherwise specified, viscosity is measured at 25° C. (22–26° C.) using a Brookfield RVTD Digital Viscometer with Spindle #2 at 50 rpm.

EXAMPLE 1

A method of preparation of a compositions of the invention (Composition D) is described below.

EXAMPLE 1

A method of preparation of a compositions of the invention (Composition D) is described below.

Composition D

| Component | Weight Percent |
|---|---|
| Ditallow ester triethanol amine quaternary ammonium methyl sulfate | 7.33 |
| Glycerol monostearate | 1.38 |
| $C_{13}$—$C_{15}$ alcohol EO 20:1 | 0.6 |
| Dequest 2000[1] | 0.1 |
| Dye | 0.002 |
| Calcium chloride | 0.05 to 0.5 (as needed for viscosity) |
| Perfume | 0.2–0.8 |
| Water | Balance |

[1]A phosphonate sequestering agent marketed by Monsanto Chemical Company

Water was heated to 60° C. and then the dye, the Dequest sequestrant and the nonionic emulsifier were dissolved in the heated water to form a first part.

In a second vessel, the diesterquat softener and the glycerol monostearate were melted and blended with a mixer at 60° C. The resulting homogeneous blend was then dispersed under agitation into the above described first part. Mixing was maintained for about 10 minutes until a homogeneous emulsion was formed. The resulting emulsion was allowed to cool at 25° C. while maintaining agitation.

To the cooled emulsion there was added perfume under agitation. The viscosity of the softener was then adjusted to between 100 to 200 cps by the addition of calcium chloride.

EXAMPLE 2

To demonstrate the significance with regard to product stability of using an emulsifier in accordance with the invention versus using emulsifiers described in the prior art for use with quaternary ammonium softeners, the following aging tests were conducted.

Three softening compositions were prepared as described in Example 1 based on diester quat and GMS and are designated compositions A, B and C.

TABLE 1

| | Composition A | Composition B | Composition C |
|---|---|---|---|
| Diesterquat | 7.33 | 7.33 | 7.33 |
| GMS | 1.38 | 1.38 | 1.38 |
| Perfume | 0.2–0.8 | 0.2–0.8 | 0.2–0.8 |
| Synperonic A20 | 0.60 | | |
| C16-18 19EO | | 0.60 | |
| C12-15 3EO | | 0.60 | |
| Colorant | 0.0018 | 0.0018 | 0.0018 |
| Preservative | 0.2 | 0.2 | 0.2 |
| Water | up to 100 | up to 100 | up to 100 |

Composition A is in accordance with the invention and contained Synperonic A20 as the emulsifier; Composition B is a comparative composition which contained as the emulsifier a fatty alcohol ethoxylate $C_{16}$–$C_{18}$ fatty alcohol with 19 moles of ethylene oxide and having an HLB value of 6.5. Composition C is a comparative composition which contained as the emulsifier a fatty alcohol ethoxylate $C_{12}$–$C_{13}$ fatty alcohol with 3 moles of ethylene oxide having an HLB value of 1.81.

The three compositions were prepared as described above and the viscosity was measured directly after making; after 1 day; and after 6 weeks at temperatures of 4° C., room temperature; 35° C.; and 43° C. The results are shown in Table 2.

TABLE 2

Aging viscosity data for softening compositions as a function of emulsifier HLB

| | Composition A | Composition B | Composition C |
|---|---|---|---|
| HLB of emulsifier | 8.25 | 6.5 | 1.81 |
| After Making | 84 cps | 107 cps | >800 |
| 1 Day | 116 | 164 | >800 |
| After 6 Weeks | | | |
| 4° C. | 176 | 240 | >800 |
| RT | 133 | 178 | >800 |
| 35° C. | 165 | 248 | >800 |
| 43° | 250 | 436 | >800 |

As demonstrated in Table 2, only Composition A in accordance with the invention remained stable, below 300 cps, after 6 weeks of aging at 43° C. Compositions B and C were unacceptable because of instability.

EXAMPLE 3

To demonstrate the significance of the HLB value of the emulsifier with regard to the stability of a diester quat and GMS composition such as shown in Table 1 of Example 2, six compositions are prepared varying only in the particular emulsifier selected. Aging is carried out for 6 weeks at a temperature of 35° C.

The emulsifiers used in each of the six compositions tested are described below in Table 3, which provides the HLB value and the resulting stability of the composition at the conclusion of the aging test.

TABLE 3

Aging stability for softening compositions as a function of the emulsifier HLB (Davies)

| Emulsifier | HLB | Aging Results |
|---|---|---|
| $C_{13}$—$C_{15}$ 20EO | 8.25 | satisfactory stability |
| $C_{13}$—$C_{15}$ 25EO | 9.9 | satisfactory |
| $C_{16}$—$C_{18}$ 30EO | 9.7 | satisfactory |
| $C_{16}$—$C_{18}$ EO | 4.7 | unstable viscosity |
| $C_{10}$ EO 15:1 | 8.5 | satisfactory |
| $C_{10}$ EO 5:1 | 4.2 | unstable viscosity |

What is claimed is:

1. A stable, pourable and water dispersible liquid fabric softener composition comprising:

(a) from about 1% to about 25% by weight of a combination of fabric softening components (A) and (B) wherein (A) is a biodegradable fatty ester quaternary ammonium compound of formula II:

(II)

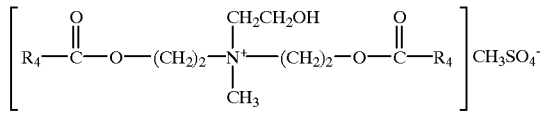

wherein each $R_4$ independently represents an aliphatic hydrocarbon group having from 8 to 22 carbon atoms, and (B) is glycerol monostearate;

(b) an effective amount of an emulsifier comprising a fatty alcohol ethoxylate nonionic surfactant having a hydrophilic-lipophilic balance (HLB) value greater than about 8.25 as measured by the Davies Group Number Method; and (c) an aqueous solvent.

2. A fabric softener composition in accordance with claim 1 wherein the diester quaternary ammonium compound is N-methyl-N,N,N-triethanolamine ditallowester quaternary ammonium methosulfate.

3. A fabric softener composition in accordance with claim 1 wherein said emulsifier is an ethoxylated $C_{13}$–$C_{15}$ fatty alcohol with 20 moles of ethoxylation per mole of alcohol.

4. A fabric softener composition in accordance with claim 1 wherein the amount of component (A) in the composition is from about 1% to about 20%, by weight, and the amount of component (B) is from about 0.1% to about 8%, by weight.

5. A method of imparting softness to fabrics comprising contacting the fabrics with an effective amount of the fabric softener composition of claim 1.

6. The method of claim 5 wherein said fabrics are contacted during the rinse cycle of an automatic laundry washing machine.

7. The method of claim 5 wherein said fabrics are contacted during a hand wash or rinse.

* * * * *